US006203173B1

(12) United States Patent
Duff et al.

(10) Patent No.: US 6,203,173 B1
(45) Date of Patent: Mar. 20, 2001

(54) LIGHTING ASSEMBLY HAVING ABOVE WATER AND UNDERWATER OPERATIONAL CAPABILITIES

(75) Inventors: David Duff, Woodside; Mark W. Fuller, North Hollywood; Robert Backman, Glendale, all of CA (US)

(73) Assignee: Wet Enterprises, Inc., Universal City, CA (US)

( * ) Notice: Subject to any disclaimer, the term of this patent is extended or adjusted under 35 U.S.C. 154(b) by 0 days.

(21) Appl. No.: 09/172,939

(22) Filed: Oct. 14, 1998

(51) Int. Cl.[7] ..... F21V 29/00; F21V 5/00; F21V 17/00

(52) U.S. Cl. ..... 362/268; 362/267; 362/331; 362/455

(58) Field of Search ..... 362/267, 268, 362/375, 455, 96, 101, 331, 374

(56) References Cited

U.S. PATENT DOCUMENTS

| | | | | |
|---|---|---|---|---|
| Re. 34,709 | * | 8/1994 | Tyson | 362/267 |
| 4,661,893 | | 4/1987 | Robinson et al. | 362/267 |
| 4,975,811 | | 12/1990 | Fraser et al. | 362/96 |
| 5,016,151 | | 5/1991 | Mula | 362/267 |
| 5,207,499 | | 5/1993 | Vajda et al. | 362/96 |
| 5,481,443 | | 1/1996 | Wagner et al. | 362/267 |
| 5,800,045 | * | 9/1998 | Kish et al. | 362/375 |

FOREIGN PATENT DOCUMENTS

| | | | | |
|---|---|---|---|---|
| 423742 | * | 2/1935 | (GB) | 362/268 |
| 599225 | * | 3/1948 | (GB) | 362/268 |
| 92/04579 | * | 3/1992 | (WO) | 362/268 |

* cited by examiner

*Primary Examiner*—Audrey Chang
*Assistant Examiner*—Jennifer Winstedt
(74) *Attorney, Agent, or Firm*—Blakely, Sokoloff, Taylor & Zafman LLP

(57) ABSTRACT

The invention relates to an water lighting system for illuminating the features of water displays where the system can be maintained with relative ease. The system has a plurality of finger clamps disposed about the perimeter of a housing that permit the installation and removal of a front lens without tools. With the front lens removed, the system further has an optical cassette that can easily be removed without tools to expose the lamp. The lamp then can be replaced without the need for tools or without accidentally touching a lens in the optical cassette. Other features are disclosed.

46 Claims, 7 Drawing Sheets

LIGHTING ASSEMBLY HAVING ABOVE WATER AND UNDERWATER OPERATIONAL CAPABILITIES

BACKGROUND OF THE INVENTION

1. Field of the Invention

The present invention relates generally to lighting systems, and more particularly to lighting systems that can operate in air or fully or partially submerged in water.

2. Prior Art

Water displays such as fountains or cascades are used to bring pleasure through their contextually motivated water features. In the absence of physical barriers, these displays invite participation from the audience and enables each water feature to interact with its surrounding landscape. To enhance the synthesis, kinetics, context, and interaction features that are innate in such water displays, color and light from underwater lighting systems are incorporated with the display to accentuate the unique character of the display.

In conventional underwater lighting systems, a lamp may be used to provide light through optical elements that are located within the lighting system. The process of maintaining the lighting system such as by changing out the lamp is a slow process that requires tools and frequently results in finger prints on the optical elements. Moreover, where underwater lighting systems are used in lakes and large bodies of water, the heavier-than-water lighting systems need to receive extra support while the lamp is being changed.

For example, in U.S. Pat. No. 4,661,893, the top of the enclosure of an underwater lighting system is fastened by screws, necessitating the need to manipulate a tool while steadying the lighting system in order to remove the enclosure top and change the lamp. Other inventions characterize the same problems. See, for example, U.S. Pat. No. 5,481,443 (In-ground directional light fixture); U.S. Pat. No. 5,207,499 (Integral light and liquid circulation fitting); U.S. Pat. No. 5,016,151 (High-intensity underwater light source); and U.S. Pat. No. 4,975,811 (Method and apparatus for illumination of a liquid droplet fountain to produce rainbows).

Thus, in a water lighting system, there is a need for an apparatus that permits quick lamp maintenance in lakes and large bodies of water, that permits quick lamp maintenance without the need for tools, and that minimizes the risk of placing finger prints on the optical elements while changing the lamp. Moreover, there is a need for a water lighting system having the capability of operating fully submerged, partially submerged, or completely dry such that the need for a thermal cutout switch, otherwise required to prevent the overheating that would be caused by the accidental dry operation of the fixture designed to be run submerged for cooling, is eliminated.

BRIEF SUMMARY OF THE INVENTION

The invention relates to a water lighting system that can be maintained with relative ease. The system has a plurality of finger clamps disposed about the perimeter of a housing that permit the installation and removal of a front lens without tools. With the front lens removed, the system further has an optical cassette having changeable optical elements for light beam and color control that can easily be removed without tools to expose the lamp. The lamp then can be replaced without the need for tools or without accidentally touching a lens in the optical cassette. Other features are disclosed.

DETAILED DESCRIPTION OF THE INVENTION

Figure 1:
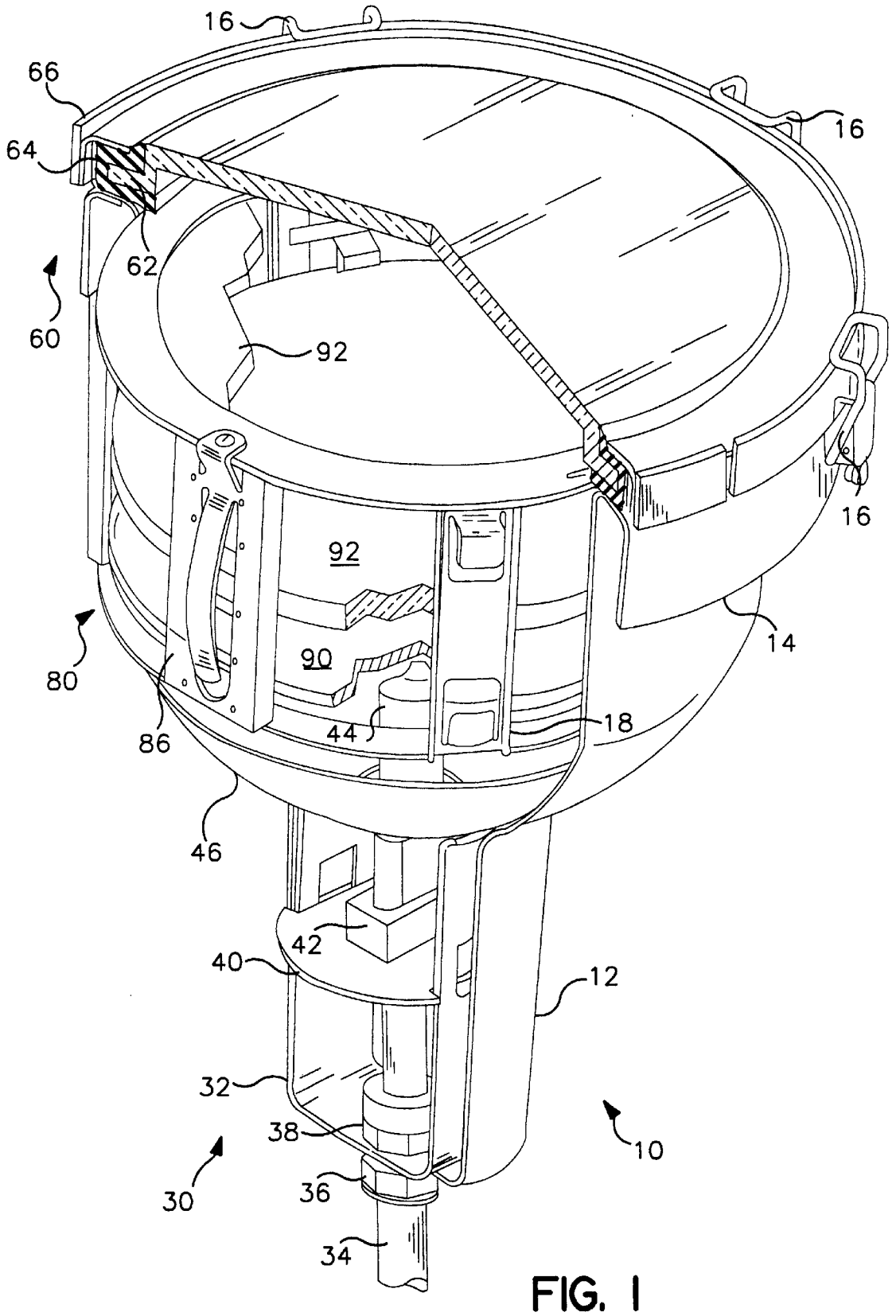
FIG. 1 is perspective view, partially cut away, of one embodiment according to the invention.

Underwater lighting systems are typically used to illuminate the features of water displays such as fountains and cascades. Maintenance on conventional underwater lighting systems is cumbersome and time consuming. The invention disclosed relates to a water lighting system that can be maintained with relative ease. The system has a plurality of finger clamps disposed about the perimeter of a housing that permit the installation and removal of a front lens without tools. With the front lens removed, the system further has an optical cassette that can easily be removed without tools to expose the lamp. The lamp then can be replaced without the need for tools or without accidentally touching a lens in the optical cassette.

For purposes of explanation, specific embodiments are set forth to provide a thorough understanding of the present invention. However, it will be understood by one skilled in the art, from reading this disclosure, that the invention may be practiced without these details. Moreover, well-known elements, devices, process steps and the like are not set forth in detail in order to avoid obscuring the present invention.

Reference is now made to FIGS. 1 through 4 to illustrate the embodiments of the invention. The invention may be comprised of four assemblies: housing assembly 10; lamp assembly 30; front lens assembly 60; and optical cassette assembly 80.

FIG. 1 is a perspective view according to the invention. As can be seen in FIG. 1, housing assembly 10 consists of shell 12, latch support ring 14, latch 16, and cassette guide rail 18. Also seen in FIG. 1 is lamp assembly 30 which consists of socket bracket 32, lamp cord 34, strain relief 36, strain relief nut 38, socket support 40, socket 42, lamp 44, reflector 46, and associated fastening devices, not shown. FIG. 1 also shows front lens assembly 60 having front lens 62, gasket 64, and clamp ring 66. The remaining elements belong to optical cassette assembly 80 and are discussed further with respect to FIG. 2.

Figure 2:
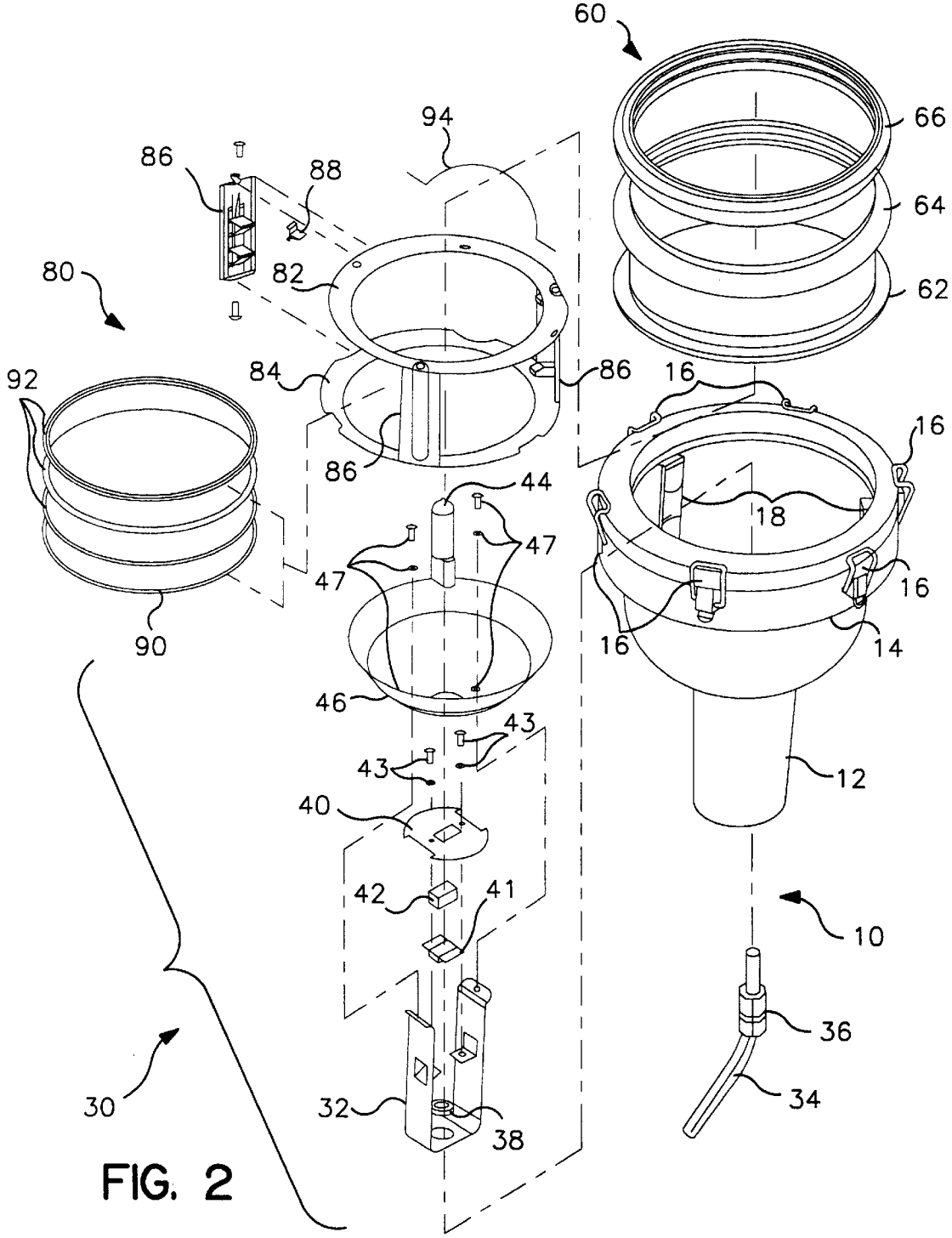
FIG. 2 is an exploded perspective view of one embodiment according to the invention.

FIG. 2 is an exploded perspective view according to the invention. Regarding housing assembly 10, shell 12 provides support for the other components of housing assembly 10 and, in the preferred embodiment, shell 12 may be made of spun stainless steel. At the top of shell 12, latch support ring 14 may be tack welded to shell 12 and, in turn, latch 16 may be spot welded to latch support ring 14. In addition to supporting each latch 16, latch support ring 14 stiffens the rim of shell 12 and locates latch 16 at a proper radius.

In the preferred embodiment there are six latches 16 disposed symmetrically about the perimeter of latch support ring 14. On the inside of shell 12, three cassette guide rails 18 are spot welded to shell 12, both to support optical cassette assembly 80 and align optical cassette assembly 80. Rather than being disposed symmetrically about the radius of shell 12, cassette guide rails 18 are placed on asymmetrical centers so that optical cassette assembly 80 may be permitted to be inserted in only one orientation.

To assemble lamp assembly 30 into housing assembly 10, socket bracket 32 may be inserted into shell 12, thereby providing an attachment base for reflector 46 and socket support 40. Threaded through a lamp cord entry in both shell 12 and socket bracket 32 may be lamp cord 34 having strain relief 36 attach to lamp cord 34 at a position somewhat below the end of lamp cord 34. In order to secure socket bracket 32 to shell 12 as well as maintain lamp cord 34 at a particular location with respect to both of these elements, strain relief nut 38 may be inserted over lamp cord 34 and tightened toward strain relief 36. Strain relief 36 may be likewise tightened toward strain relief nut 38. To provide an electrical contact point for lamp 44, socket 42 may be inserted into a hole formed into socket support 40 and held to socket support 40 by socket retaining clip 41 and associated socket screw/lock washer combination 43. Wires (not shown) from lamp cord 34 are crimped to socket 42. To complete lamp assembly 30, reflector 46 may be held to socket bracket 32 by reflector screw/lock washer/threaded insert 47, thereby allowing lamp 44 to be inserted into socket 42. Preferably, the filament (not shown) of lamp 44 may be oriented along the axis of the parabolic reflector 46. Since the filament of lamp 44 may be oriented along the axis of the parabolic reflector 46, lamp 44 works with parabolic reflector 46 to provide a good, focused beam of light. In accordance with Underwriter's Laboratory (UL) requirements, the lamp cord entry, the lamp cord, and the lamp cord wires are potted in epoxy in accordance with UL requirements so as to prevent water from entering the system.

To form front lens assembly 60, front lens 62 may be inserted into gasket 64. Clamp ring 66, having a lip that may be adapted to catch the hook of latch 16, may then be placed over the top of gasket 64. Preferably, front lens 62 may be made from borosilicate glass and clamp ring 66 may be made from metal. Gasket 64 serves to seal the system against water entry and provides mechanical isolation of glass front lens 62 from metal clamp ring 66. In the preferred embodiment, front lens 62 may be flat to minimize light divergence between front lens 62 and either a water or air interface. In an alternate embodiment discussed in connection with FIG. 8, the front lens could be curved if desired, though the divergence caused by the curvature would change between use underwater and use above water.

Optical set assembly 80 may be a frame which consists of upper cassette ring 82 and lower cassette ring 84 connected through three support pillars 86. Support pillars 86 have spring clips 88 on them to provide support for various optical lenses such as convection block lens 90 and optional lenses 92 such as a color filter lens, diffusion lens, or beam shaping lens such as a light baffle or a spread lens. Convection block lens 90 occupies the lower most portion in optical cassette assembly 80 and serves to interrupt the flow of hot convection currents from lamp 44 to both the top and bottom of the water lighting system. Having a bale 94 attached to upper cassette ring 82, optical cassette assembly 80 may be easily removed and reinserted into housing assembly 10 during relamping operations such as changing out a warn lamp 44. As can be seen in FIG. 2, only lower cassette ring 84 is notched to allow lower cassette ring 84 to pass along cassette guide rails 18 and consistently align the optical elements in optical cassette assembly 80 through the placement of cassette guide rails 18 on asymmetrical centers.

Figure 3:
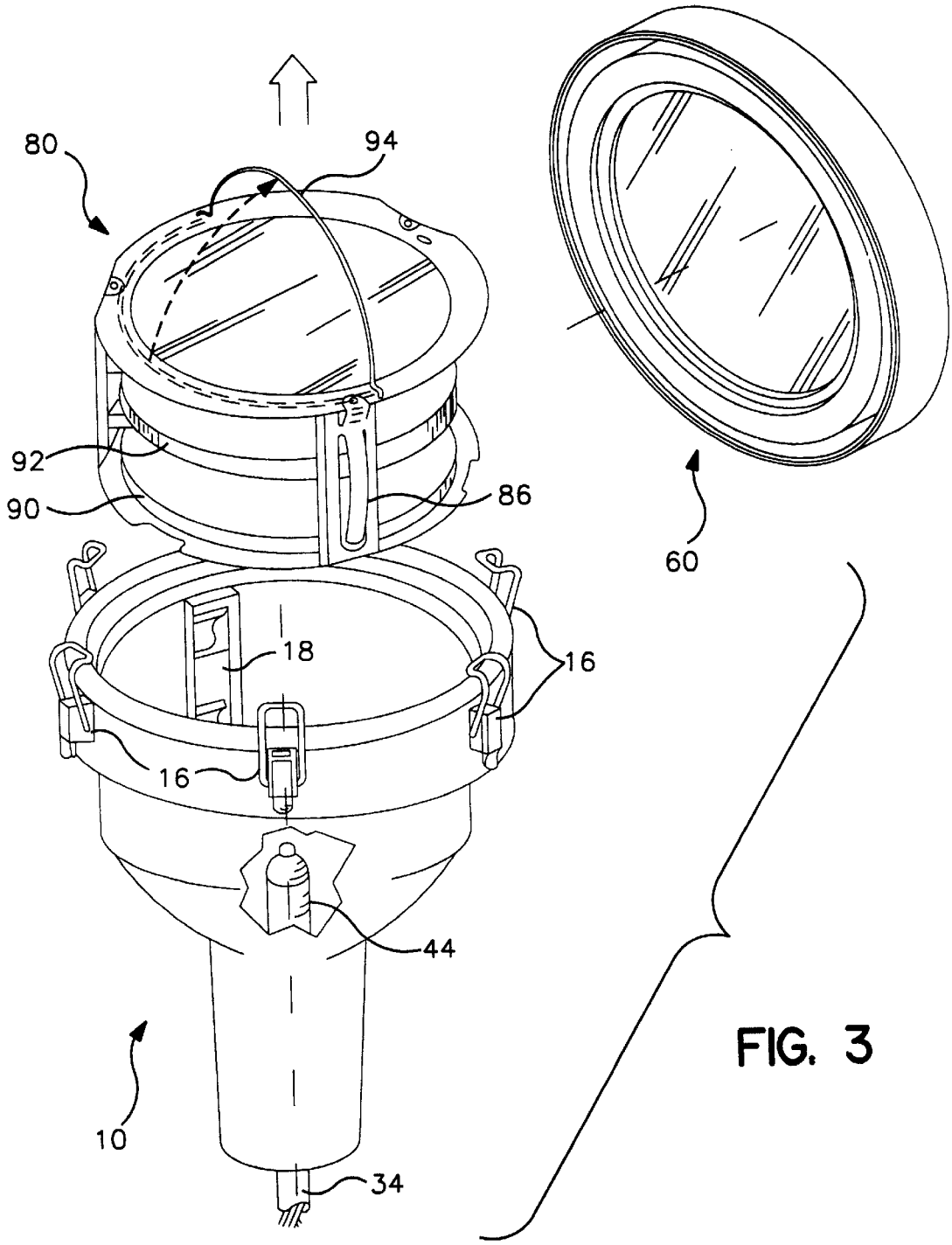
FIG. 3 is a perspective view of one embodiment showing the removal of the front lens assembly and the optical cassette assembly in order to replace the lamp.

FIG. 3 is a perspective view showing the removal of front lens assembly 60 and optical cassette assembly 80 in order to replace lamp 44. As seen in FIG. 3, each latch 16 may be released to free front lens assembly 60 from housing assembly 10. With front lens assembly 60 out of the way, the user may reach into housing assembly 10 and, by grasping onto and lifting up on bale 94 in the direction of the arrow, remove optical cassette 80 from within housing assembly 10 without touching either convection block lens 90 or optional lenses 92. With front lens assembly 60 and optical cassette 80 removed from housing assembly 10, lamp 44 may be exposed for relamping and can be replaced with a new lamp 44, the entire process being performed without the use of tools.

Figure 4:
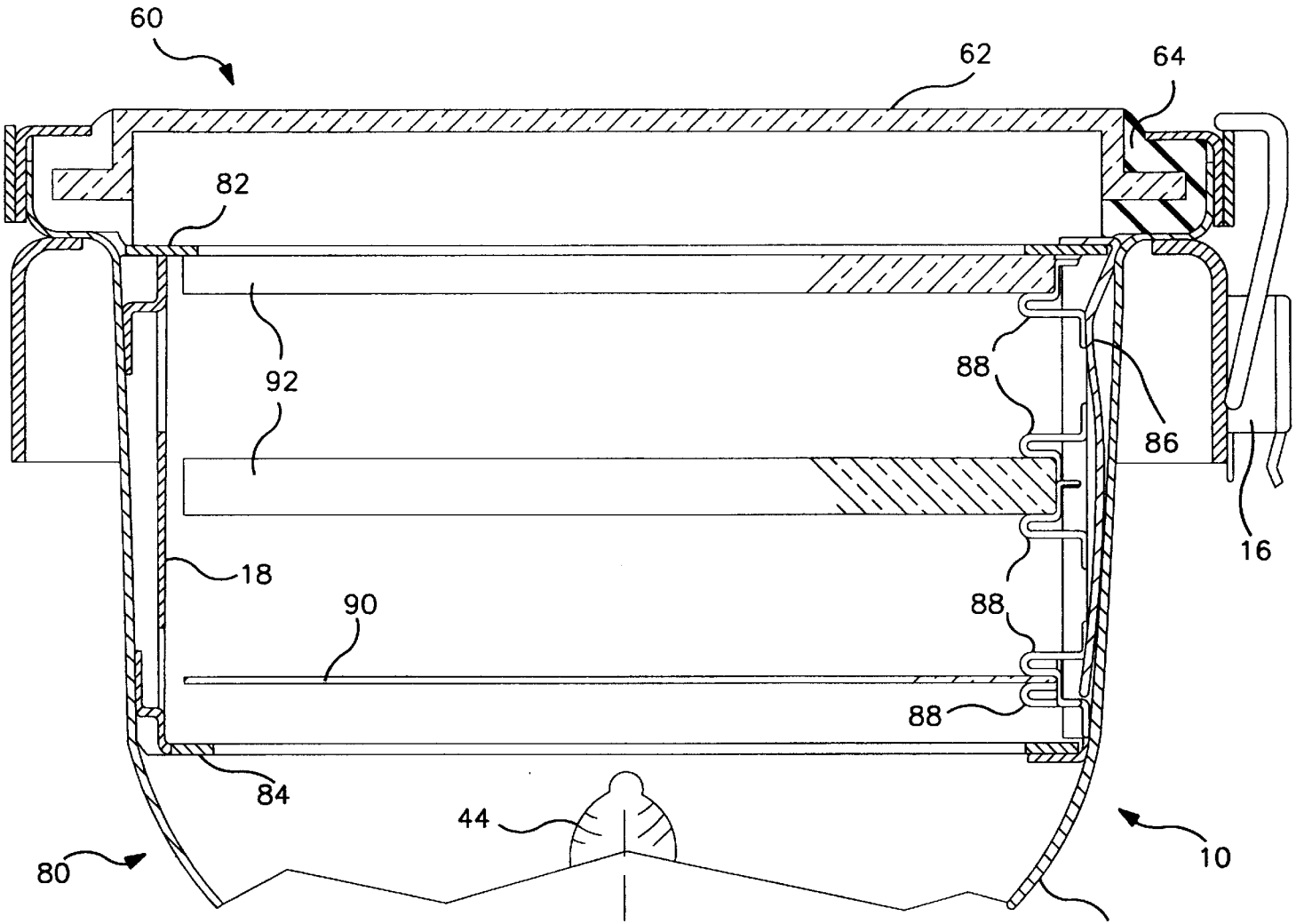
FIG. 4 is a cross section view of one embodiment showing assembly of front lens assembly and the optical cassette assembly into the housing assembly.

FIG. 4 is a cross sectional view showing assembly of the front lens assembly 60 and the optical cassette assembly 80 into the housing assembly 10. In the preferred embodiment, the characteristics of the system are selected such that the system floats. This may be accomplished by designing the cavity formed by housing assembly 10 and front lens assembly 60 to displace a greater volume weight of water than the weight of the water lighting system.

The invention can operate submerged in water, either fully or partially, or operate dry in dry air. This may be accomplished cost effectively through a combination of features that protect the thermally sensitive components of the silicone rubber gasket 64 and epoxy potting from convection heat generated by the 575 Watt lamp 44. To keep silicone rubber gasket 64 below 200 degrees Celsius, convection block lens 90 may be installed in optical cassette assembly 80 to restrict the convection currents of lamp 44 from reaching gasket 64, shown in FIG. 4. To keep the epoxy potting below 130 degrees Celsius, socket support 40 of FIG. 1 may be adapted to restrict the convection currents of lamp 44 from reaching the epoxy potting. To further minimize the travel of the convection from lamp 44, shell 12 of FIG. 4 may be made of stainless steel (low thermal conductivity) rather than a copper based alloy (high thermal conductivity) and lamp 44 resides at a distance from gasket 64 and the epoxy potting sufficient to further restrict convection currents from reaching gasket 64 and the epoxy potting. Thus, unlike conventionally water lighting systems, no thermal cutout switch is needed to turn off power to keep the system from over heating and failing if water is taken away from the system. Alternatively in the preferred embodiment, if under water use is assured, a 750 watt lamp may be used without any change to the structure of the lighting assembly. Similarly, a lower power lamp may be used for above water and underwater use, such as a 300 watt lamp. In any case, other gasket materials may alternatively be used, as one aspect of the invention may be the minimization of the elevated temperature requirements of the gasket.

Figure 5:
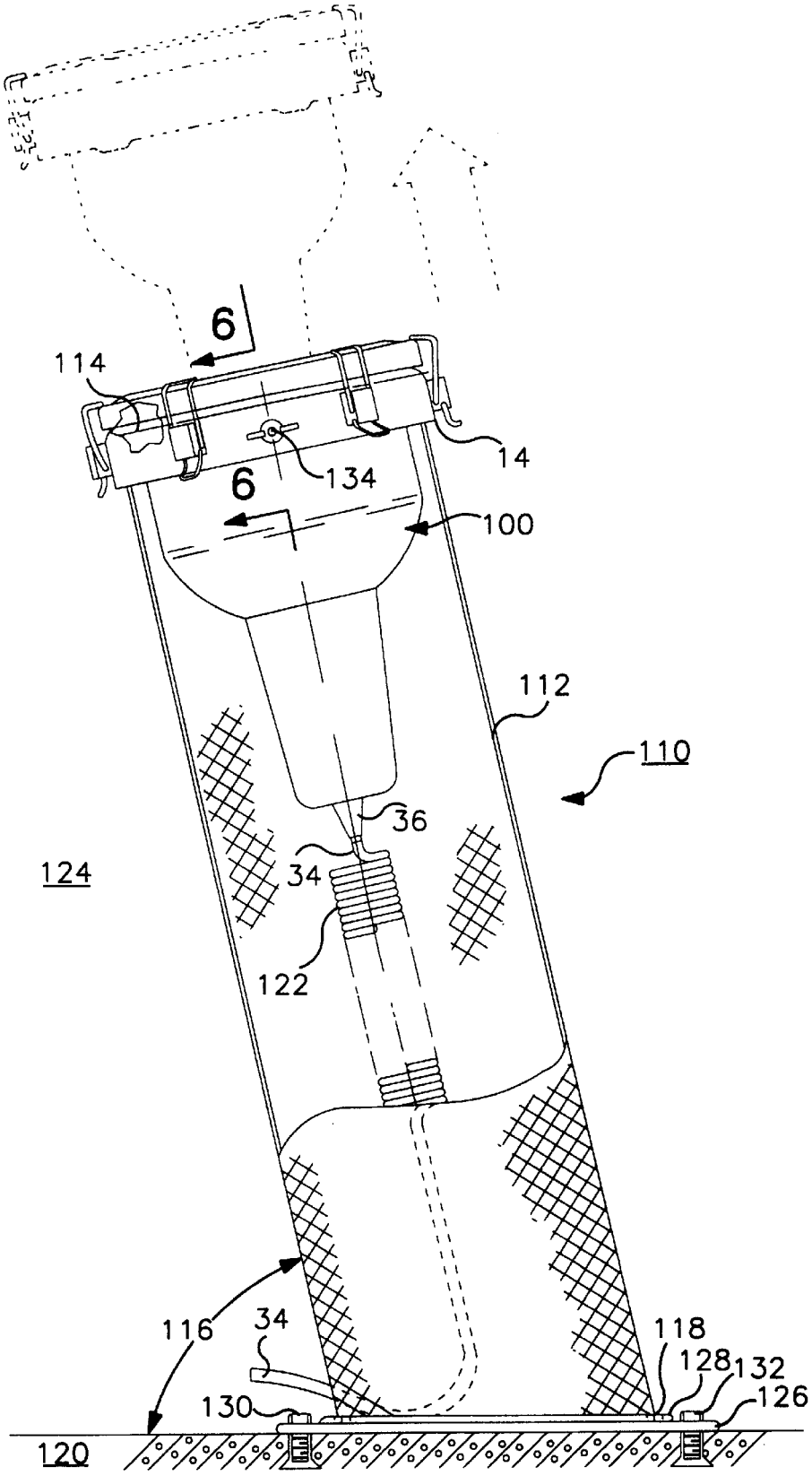
FIG. 5 is a side view of a lighting assembly mounted in a stand.

In one embodiment, the lighting assembly may be mounted in a stand. FIG. 5 is a side view of lighting assembly 100 mounted in stand 110. Stand 110 comprises cylinder 112 open at top 114, and cut at angle 116 at cylinder bottom 118 to obtain the desired mounting angle for lighting assembly 100 through stand 110. Since the axis of lighting assembly 100 preferably may be coexistent with the axis of cylinder 112, the mounting angle of lighting assembly 100 may be a function of angle 116.

To prevent movement of the water from interfering with the desired mounting angle by permitting water to pass through cylinder 112. Cylinder 112 may be made from a perforated stainless steel sheet such as manufactured by Diamond Perforated Metals, Inc. of Visalia, Calif. or manufactured by providing staggered slits in a sheet of stainless steel and then stretching the same in a direction perpendicular to the slits to pull the slits open. Preferably, the perforation openings of cylinder 112 are equally spaced about the circumference of cylinder 112. To create a cylindrical form, the material of cylinder 112 may be welded into a diameter that just fits under latch support ring 14 of lighting assembly 100 as seen in FIG. 5. Cylinder 112 may be powder coated with a black waterproof powder coating so as to not generally be visible from above.

In installing lighting assembly 100, power may be brought to lighting assembly 100 either through or along pool bottom 120 through lamp cord 34. Conventionally, any extra length of a lamp cord merely flops around on the pool bottom. However, as shown in FIG. 5, lamp cord 34 enters within the circumference of cylinder 112 at cylinder bottom 118 and forms preferably into an expandable and retractable plurality of lamp cord windings 122 that neatly coil within cylinder 112. Lamp cord windings 122 provide extra length to lamp cord 34 to allow the lighter-than-water lighting assembly 100 to float to the top of pool 124 for maintenance. After removing lighting assembly 100 in the direction of the arrow in FIG. 5 to performing maintenance and on returning lighting assembly 100 to open top 114 of cylinder 112, lamp cord windings 122 neatly self-coiled within cylinder 112. To anchor cylinder 112 to pool bottom 120, plate 126 having angled female end 128 and anchoring holes 130 may be welded to cylinder bottom 118 and then bolted to pool bottom 120 with bolts 132.

Conventionally, light assemblies are mounted to a stand by using opposing screws through a U-shaped yolk where the U-shaped yolk permits a worker to adjust the angle of the lamps at the time of installation to align the lamp of the lighting assembly. The problem with such a mounting, however, is that the adjustment may be easily lost when the lighting assembly is serviced. On servicing the lighting assembly, the worker may be required to carefully readjust the alignment of the lamp. To overcome this problem, the present invention preferably uses three captured thumb screws.

Figure 6:
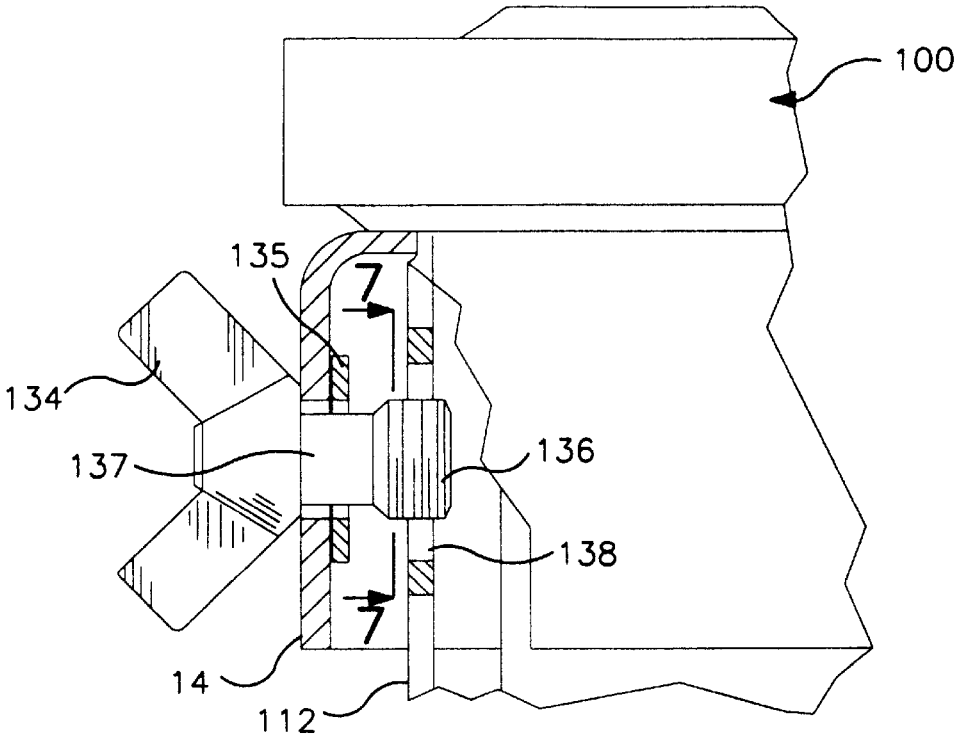
FIG. 6 is detailed view of a captured thumb screw taken generally from line 6—6 of FIG. 5.

As shown in FIG. 5, at least one captured thumb screw 134 may be inserted through latch support ring 14 on lighting assembly 100 to hold light assembly 100 to stand 110. FIG. 6 is a detailed view of captured thumb screw 134 taken generally from line 6—6 of FIG. 5. After inserting captured thumb screw 134 through latch support ring 14, threaded portion 136 of captured thumb screw 134 may be tightened through threaded lock washer 135. Since shank 137 of captured thumb screw 134 may be smaller in diameter than the inside diameter of threaded lock washer 135, threaded lock washer 135 drops onto shank 137 and freely moves about shank 137 to create a misalignment between the threads of threaded lock washer 135 and the threads of threaded portion 136. This misalignment between the threads prevents the easy removal of captured thumb screw 134 from latch support ring 14 so that captured thumb screw 134 will not be lost.

As captured thumb screw 134 is tightened into perforated opening 138 of cylinder 112, threaded portion 136 of captured thumb screw 134 passes through perforation opening 138 to seat captured thumb screw 134 against latch ring support 14 and thus lock lighting assembly 100 in place. The ingenious use of perforation opening 138 as a nut may be best seen in FIG. 7.

Figure 7:
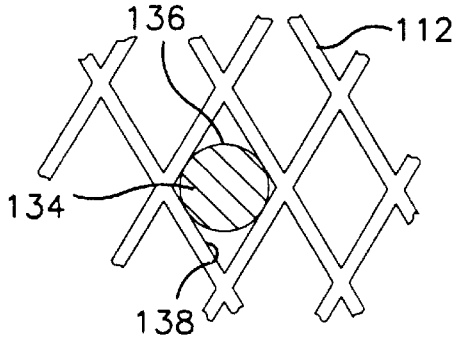
FIG. 7 is a detailed view of a captured thumb screw engaged in a perforation opening taken generally from line 7—7 of FIG. 6.

FIG. 7 is a detailed view of captured thumb screw 134 engaged in perforation opening 138 taken generally from line 7—7 of FIG. 6. As seen in FIG. 7, threaded portion 136 of captured thumb screw 134 engages each of the four internal edges of perforation opening 138 to wedge itself into perforation opening 138. Since the perforation openings of cylinder 112 are equally spaced about the circumference of cylinder 112, only minimum rotation of lighting assembly 100 may be required to align capture screw 134 with a perforation opening of cylinder 112. Since the axis of lighting assembly 100 may be coexistent with the axis of cylinder 112, alignment may be maintained even if lighting assembly 100 is rotated radially with respect to cylinder 112.

Figure 8:
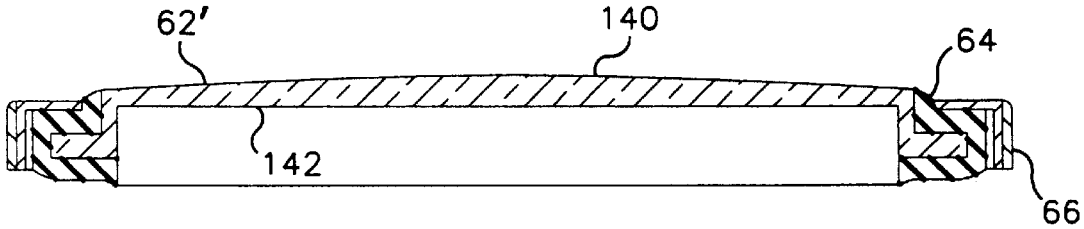
FIG. 8 is a cross sectional view showing an alternate embodiment of the front lens.

FIG. 8 is a cross sectional view showing an alternate embodiment of front lens 62'. As shown, surface 140 of front lens 62' may be exposed to the weather and may be held to a slight curved or dome shape while interior surface 142 may be maintained as flat. By holding weather surface 140 to a slight curve, the difference between the performance when lighting assembly 100 is underwater and the performance when lighting assembly 100 is above water will also be small. In other words, any divergence between use underwater and use above water caused by the curvature of front lens 62' would be slight. The advantage gained is that in those circumstances when front lens 62' may be mounted horizontally (such as when angle 116 of FIG. 5 is ninety degrees, water movement (typically oscillatory movement) in the pool, disturbs dirt, sand, and other particles on top of front lens 62' so that the slight curvature of front lens 62' works to provide a preferred, downward motion of the dirt so as to self-clean front lens 62'. This characteristic is not found in flat horizontally mounted lenses.

In one embodiment, the gasket may be a dynamic seal such as where the sealing force increases as the external pressure increases.

Figure 9:
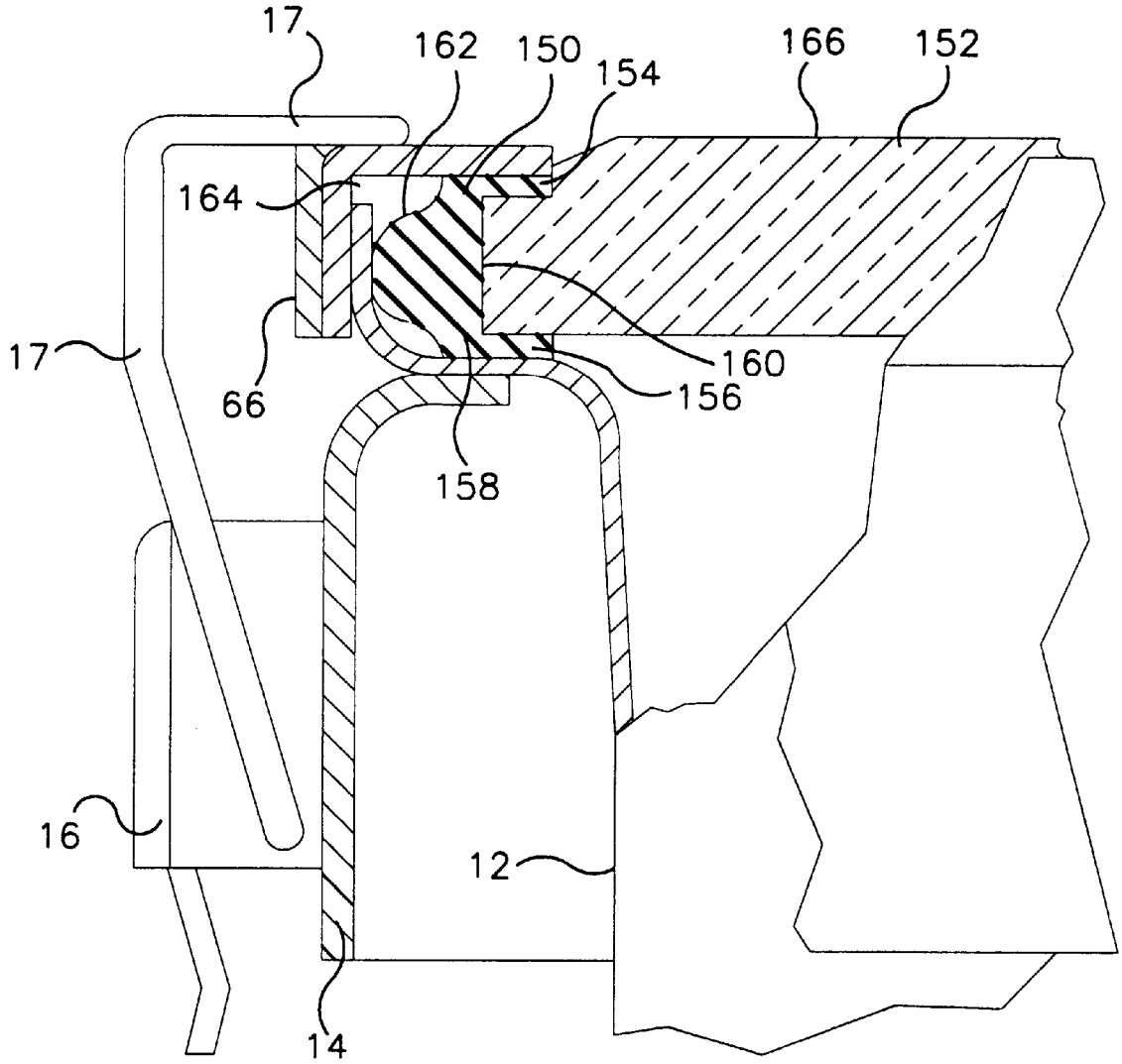
FIG. 9 is a partial cross section view of an embodiment of the gasket into which the front lens is inserted.

FIG. 9 is a partial cross sectional view of an embodiment of gasket 150 into which front lens 152 may be inserted. As shown in FIG. 9, gasket 150 comprises an internal annulus ring having upper lip 154 and lower lip 156 coupled between band 158 to form annulus grove 160. Extending radially outward from band 158 may be convex rib 162. To account for the vertical height of annulus grove 160, the thickness of front lens 152 may be reduced around the perimeter of front lens 152 over a radial distance that matches the inside length of upper lip 154.

In assembly, latch support ring 14 may be tack or spot welded to the under exterior of shell 12 as shown in FIG. 9. Latch 16 may be then spot welded in at least two places to latch support ring 14. To ready front lens 152 for assembly into shell 12, front lens 152 may be inserted into annulus grove 160 of gasket 150. This assembly may then be lowered into place within shell 12. To provide a solid surface onto which hook 17 of latch 16 may catch, clamp ring 66 may be place onto the assembly of front lens 152 into gasket 150. Hook 17 may then be brought about on to the top surface of clamp ring 66 and compresses gasket 150 by being locked into place. In the assembly, gap 164 may be provided between the uppermost rim of shell 12 and the under surface of clamp ring 66. Gap 164 permits the assembly to adjust to any increase in axial pressure on surface 166 of front lens 152. Other known sealing techniques such as u-cups seals or hydraulic seals may also be used.

While the present invention has been particularly described with reference to the various Figures, it should be understood that the Figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. A lamp apparatus for a water lighting system, the apparatus comprising:

a housing;

a front lens adapted to be secured to the housing;

a lamp disposed within the housing; and an optical cassette disposed between the lamp and the front lens, the optical cassette adapted to be installed into and removed from the housing, the optical cassette having a bail attached thereto.

2. The lamp apparatus of claim 1 wherein the front lens is flat.

3. The lamp apparatus of claim 1, the optical cassette having provisions to receive a plurality of lenses and having at least one of the following lenses: convection block lens, color filter lens, diffusion lens, and beam shaping lens.

4. The lamp apparatus of claim 3, wherein the beam shaping lens is a light baffle lens.

5. The lamp apparatus of claim 3, wherein the beam shaping lens is a spread lens.

6. The lamp apparatus of claim 1, wherein the optical cassette is keyed to a particular alignment within the housing.

7. The lamp apparatus of claim 6, the housing further having an interior surface and the apparatus further comprising a plurality of optical cassette guide rails disposed asymmetrically about the interior surface of the housing.

8. The lamp apparatus of claim 1, the housing and front lens forming a cavity, the cavity adapted to displace a greater volume weight of water than the weight of the water lighting system such that the system floats.

9. The lamp apparatus of claim 1, further comprising:

a gasket disposed about the front lens;

a socket disposed within the housing, the lamp disposed into the socket;

a lamp cord entry formed into the housing;

a lamp cord inserted into the housing through the lamp cord entry and coupled to the socket; and epoxy, wherein the lamp cord entry, the lamp cord, and the lamp cord wires are potted in epoxy in accordance with UL requirements so as to prevent water from entering the lamp apparatus.

10. The lamp apparatus of claim 9, the lamp cord having wires crimped to the socket and to a ground.

11. The lamp apparatus of claim 9, wherein the limitations of the system are adapted such that the system operates fully submerged in water.

12. The lamp apparatus of claim 9, wherein the limitations of the system are adapted such that the system operates partially submerged in water.

13. The lamp apparatus of claim 9, wherein the limitations of the system are adapted such that the system operates dry.

14. The lamp apparatus of claim 9, the lamp having a hot region that causes convection currents, the optical cassette having a convection block lens that restricts the convection currents of the lamp from reaching the gasket, the socket having a socket support, the socket support adapted to restrict the convection currents of the lamp from reaching the epoxy, and the lamp residing at a distance from the gasket and the epoxy that further restricts convection currents from reaching the gasket and the epoxy.

15. The lamp apparatus of claim 9, the housing made of stainless steel material, and the lamp residing at a distance from the gasket and the epoxy that further restricts convection currents from reaching the gasket and the epoxy.

16. The lamp apparatus of claim 1, the housing having a perimeter and a plurality of finger clamps disposed about the perimeter and the front lens is adapted to be secured to the housing by the plurality of finger clamps.

17. A lamp apparatus for a water lighting system, the apparatus comprising:

a housing having an interior surface;

a plurality of optical cassette guide rails disposed asymmetrically about the interior surface of the housing;

a front lens adapted to be secured to the housing;

a lamp disposed within the housing; and an optical cassette disposed between the lamp and the front lens, the optical cassette adapted to be installed into and removed from the housing, the optical cassette having a bail attached thereto, the optical cassette being keyed to the plurality of optical cassette guide rails with a particular alignment within the housing.

18. The lamp apparatus of claim 17 wherein the front lens is flat.

19. The lamp apparatus of claim 17, the optical cassette having provisions to receive a plurality of lenses and having at least one of the following lenses: convection block lens, color filter lens, diffusion lens, and beam shaping lens.

20. The lamp apparatus of claim 19, wherein the beam shaping lens is a light baffle lens.

21. The lamp apparatus of claim 19, wherein the beam shaping lens is a spread lens.

22. The lamp apparatus of claim 17, the housing and front lens forming a cavity, the cavity adapted to displace a greater volume weight of water than the weight of the water lighting system such that the system floats.

23. The lamp apparatus of claim 17, the housing having a perimeter and a plurality of finger clamps disposed about the perimeter and the front lens is adapted to be secured to the housing by the plurality of finger clamps.

24. The lamp apparatus of claim 17, further comprising:

a gasket disposed about the front lens;

a socket disposed within the housing, the lamp disposed into the socket;

a lamp cord entry formed into the housing;

a lamp cord inserted into the housing through the lamp cord entry and coupled to the socket;

and epoxy, wherein the lamp cord entry, the lamp cord, and the lamp cord wires are potted in epoxy in accordance with UL requirements so as to prevent water from entering the lamp apparatus.

25. The lamp apparatus of claim 24, the lamp cord having wires crimped to the socket and to a ground.

26. The lamp apparatus of claim 24, wherein the limitations of the system are adapted such that the system operates fully submerged in water.

27. The lamp apparatus of claim 24, wherein the limitations of the system are adapted such that the system operates partially submerged in water.

28. The lamp apparatus of claim 24, wherein the limitations of the system are adapted such that the system operates dry.

29. The lamp apparatus of claim 24, the lamp having a hot region that causes convection currents, the optical cassette having a convection block lens that restricts the convection currents of the lamp from reaching the gasket, the socket having a socket support, the socket support adapted to restrict the convection currents of the lamp from reaching the epoxy, and the lamp residing at a distance from the gasket and the epoxy that further restricts convection currents from reaching the gasket and the epoxy.

30. The lamp apparatus of claim 24, the housing made of stainless steel material, and the lamp residing at a distance from the gasket and the epoxy that further restricts convection currents from reaching the gasket and the epoxy.

31. A lamp apparatus for a water lighting system, the apparatus comprising:

a housing;

a front lens adapted to be secured to the housing;

a gasket disposed about the front lens;

a lamp disposed within the housing, the lamp having a hot region that causes convection currents, the lamp residing at a distance from the gasket that restricts convection currents from reaching the gasket; and an optical cassette disposed between the lamp and the front lens, the optical cassette adapted to be installed into and removed from the housing, the optical cassette having a convection block lens that restricts the convection currents of the lamp from reaching the gasket.

32. The lamp apparatus of claim 31 wherein the front lens is flat.

33. The lamp apparatus of claim 31, the optical cassette having provisions to receive a plurality of lenses and having at least one of the following lenses: convection block lens, color filter lens, diffusion lens, and beam shaping lens.

34. The lamp apparatus of claim 33, wherein the beam shaping lens is a light baffle lens.

35. The lamp apparatus of claim 33, wherein the beam shaping lens is a spread lens.

36. The lamp apparatus of claim 31, wherein the optical cassette is keyed to a particular alignment within the housing.

37. The lamp apparatus of claim 31, the housing further having an interior surface and the apparatus further comprising a plurality of optical cassette guide rails disposed asymmetrically about the interior surface of the housing.

38. The lamp apparatus of claim 31, the optical cassette having a bail attached thereto.

39. The lamp apparatus of claim 31, the housing and front lens forming a cavity, the cavity adapted to displace a greater volume weight of water than the weight of the water lighting system such that the system floats.

40. The lamp apparatus of claim 31, the housing having a perimeter and a plurality of finger clamps disposed about the perimeter and the front lens is adapted to be secured to the housing by the plurality of finger clamps.

41. The lamp apparatus of claim 31, further comprising:

a gasket disposed about the front lens;

a socket disposed within the housing, the lamp disposed into the socket;

a lamp cord entry formed into the housing;

a lamp cord inserted into the housing through the lamp cord entry and coupled to the socket;

and epoxy, wherein the lamp cord entry, the lamp cord, and the lamp cord wires are potted in epoxy in accordance with UL requirements so as to prevent water from entering the lamp apparatus.

42. The lamp apparatus of claim 41, the lamp cord having wires crimped to the socket and to a ground.

43. The lamp apparatus of claim 42, wherein the limitations of the system are adapted such that the system operates fully submerged in water.

44. The lamp apparatus of claim 42, wherein the limitations of the system are adapted such that the system operates partially submerged in water.

45. The lamp apparatus of claim 42, wherein the limitations of the system are adapted such that the system operates dry.

46. The lamp apparatus of claim 31, wherein the housing made of stainless steel material.

* * * * *